US008345070B2

(12) United States Patent
Suen et al.

(10) Patent No.: US 8,345,070 B2
(45) Date of Patent: Jan. 1, 2013

(54) APPARATUS AND METHOD FOR FRAME RATE UP CONVERSION

(75) Inventors: Wei-Ting Suen, Tainan County (TW); Ling-Hsiu Huang, Tainan County (TW); Lin-Kai Bu, Tainan County (TW)

(73) Assignee: Himax Media Solutions, Inc., Sinshih Township, Tainan County (TW)

( * ) Notice: Subject to any disclaimer, the term of this patent is extended or adjusted under 35 U.S.C. 154(b) by 875 days.

(21) Appl. No.: 12/481,822

(22) Filed: Jun. 10, 2009

(65) Prior Publication Data

US 2010/0315548 A1 Dec. 16, 2010

(51) Int. Cl.
*G09G 5/10* (2006.01)

(52) U.S. Cl. ..... 345/690; 345/428; 345/589; 345/691; 348/441; 348/451; 348/443

(58) Field of Classification Search ..... None
See application file for complete search history.

(56) References Cited

U.S. PATENT DOCUMENTS

2007/0081586 A1* 4/2007 Raveendran et al. ..... 375/240.1

* cited by examiner

*Primary Examiner* — Antonio A Caschera
(74) *Attorney, Agent, or Firm* — McClure, Qualey & Rodack, LLP

(57) ABSTRACT

A method for frame rate up conversion. The method is executed by a frame rate up-converter. The frame rate up-converter receives a plurality of consecutive input video frames and detects luminance information for a current frame. The frame rate up-converter generates a first output frame according to the luminance information for the current frame and a preceding frame before the current frame and generates a second output frame according to the luminance information for the current frame and a succeeding frame after the current frame, wherein the second output frame is outputted after the first output frame.

10 Claims, 5 Drawing Sheets

APPARATUS AND METHOD FOR FRAME RATE UP CONVERSION

FIELD OF THE INVENTION

The embodiments described herein relate generally to frame rate up conversion (FRUC), and more particularly, to an apparatus and method for frame rate up conversion (FRUC) with luminance compensation.

DESCRIPTION OF THE RELATED ART

An LCD panel comprises a plurality of pixels therein. Each pixel of an LCD panel can be driven to a specific pixel value for luminance thereof. However, motion blur around moving objects displayed on an LCD panel may occur, due to delay in response time of liquid crystals to change in pixel values. In order to overcome the motion blue phenomenon, technique of frame rate up conversion (FRUC) is applied. Generally, FRUC is the process of video interpolation at the video decoder to increase the perceived frame rate of the reconstructed video. Moreover, FRUC needs to perform motion estimation to find required motion vectors between two frames and then to interpolate a new frame inserted in the two frames based on precise motion vectors. Unfortunately, the estimation of the precise motion vectors is difficult, complex and high cost.

Thus, a new method and apparatus for frame rate up conversion to reduce LCD motion blur is called for.

BRIEF SUMMARY OF INVENTION

A detailed description is given in the following embodiments with reference to the accompanying drawings.

In one aspect, the present invention provides a method for frame rate up conversion. The method comprises the steps of: receiving a plurality of consecutive input video frames; detecting luminance information for a current frame; generating first adjusting information according to the luminance information for the current frame and a preceding frame before the current frame, and generating second adjusting information according to the luminance information for the current frame and a succeeding frame after the current frame; and generating the first output frame according to the first adjusting information, and the second output frame according to the second adjusting information.

In another aspect, the present invention provides a frame rate up-converter. The device comprises: a luminance detector detects luminance information for a current frame; an overdrive controller generates a first output frame according to the luminance information for the current frame and a preceding frame before the current frame, and generate a second output frame according to the luminance information for the current frame and a succeeding frame after the current frame, wherein the second output frame is outputted after the first output frame. The overdrive controller comprises a compensation circuit and a frame generator. The compensation circuit generates first adjusting information according to the luminance information for the current frame and a preceding frame, and generates second adjusting information according to the luminance information for the current frame and a succeeding frame. A frame generator generates the first output frame according to the first adjusting information and generating the second output frame according to the second adjusting information.

The above-mentioned method for frame rate up conversion and apparatus receive a consecutive input video frames at a input frame rate to obtain a new consecutive video frames at a new frame rate which is faster than the input frame rate, thus improve the responses time of the new video frames with luminance overdrive to efficiently reduce motion blur.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
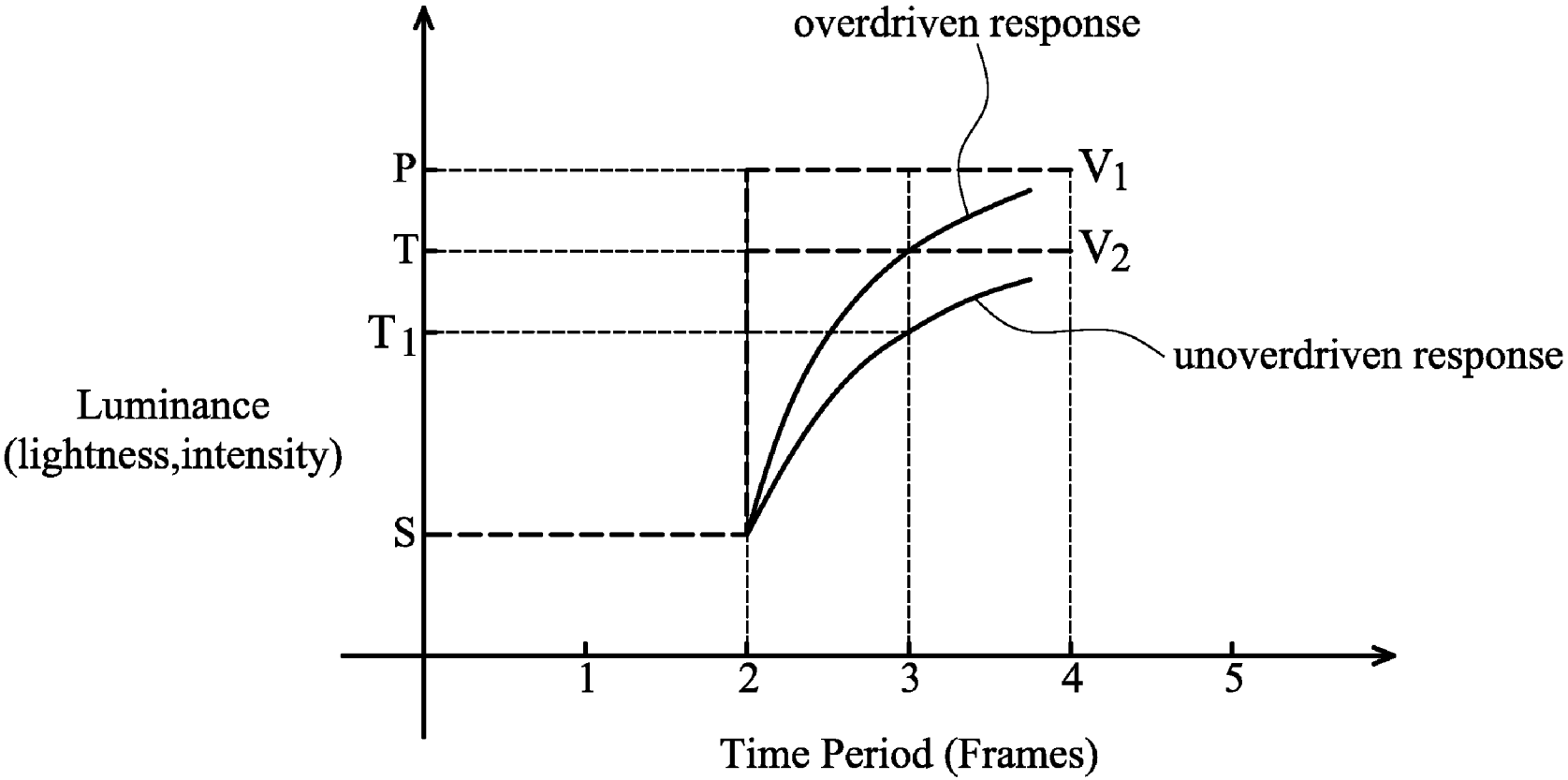
FIG. 1 shows luminance variations of a pixel accompanying time based on an underdriven luminance response and an overdriven luminance response.

FIG. 1 shows a luminance variation of a pixel accompanying time based on an unoverdriven luminance response curve and an overdriven luminance response curve. The luminance of a pixel is value S at the beginning of a frame 2, and the pixel is determined to achieve a target value T at the beginning of a next frame 3. In general, when the pixel is not overdriven (i.e. voltage V2 is applied), the luminance of the pixel at the beginning of the next frame 3 is value T1 rather than target value T. The value T1 lower than the target pixel value T result in motion blur in subsequent frames. Thus, when the pixel is overdriven (i.e. voltage V1 is applied), the luminance of the pixel at the beginning of the next frame 3 will be the target value T thereby eliminating blur in subsequent frames.

It should be noted that the overdrive method requires information on a timely and accurate characterization of the LCD panel's optical response. The overdrive unit determines applied voltage values for luminance of the pixels to display luminance of the pixels of the video frames on the LCD according to the characterization of the LCD panel's optical response.

Figure 2:
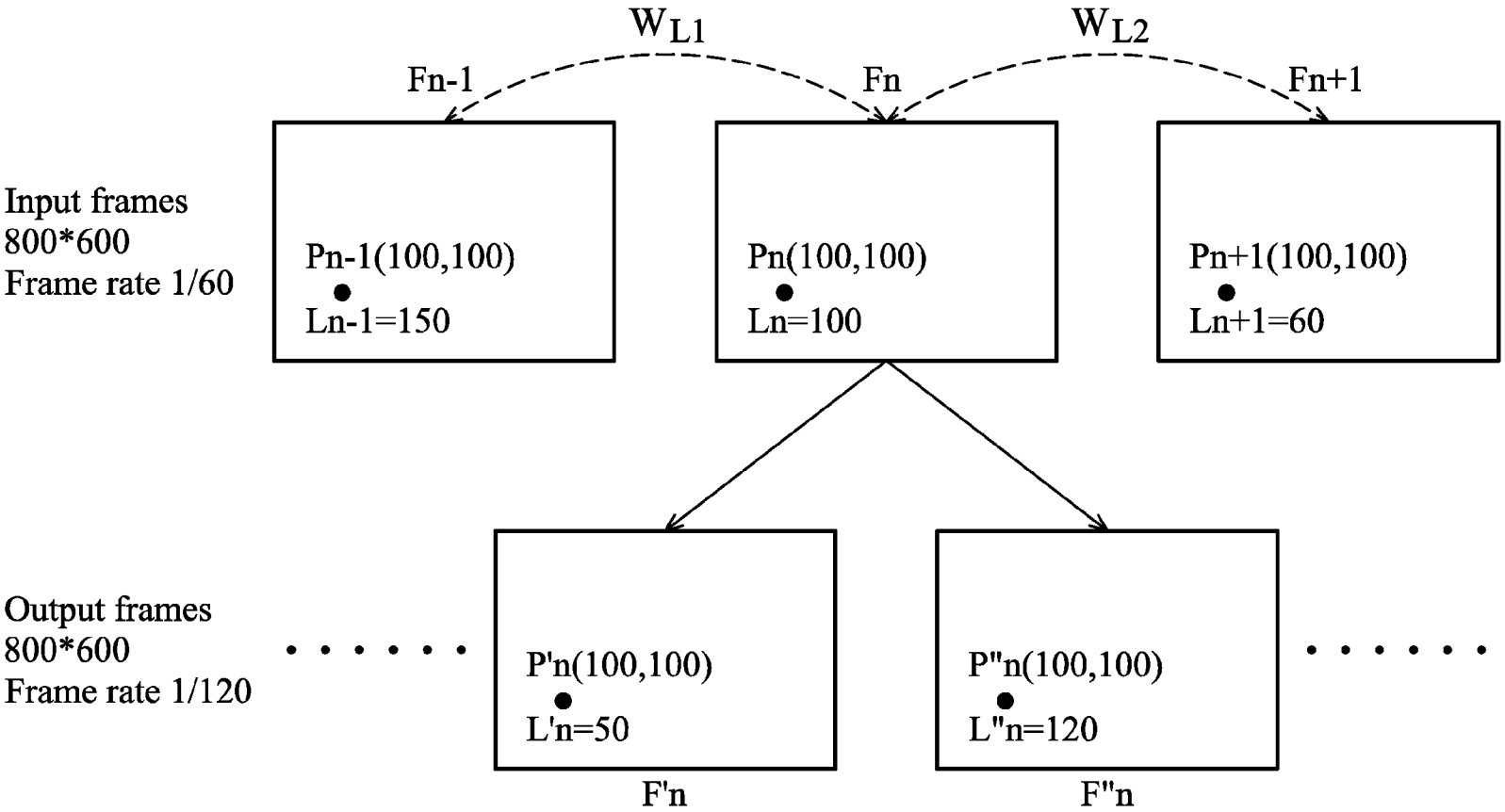
FIG. 2 shows an exemplary diagram illustrating a luminance of a pixel within an output frame is compensated according to an embodiment of the present invention.

FIG. 2 is a diagram showing a luminance of a pixel within an output frame is compensated according to an embodiment of the present invention. As shown in FIG. 2, the input frames have visible size of 800*600 and frame rate 1/60. The pixels $P_{n-1}$, $P_n$ and $P_{n+1}$, at the coordinate (100*100) within the input frames $F_{n-1}$, $F_n$ and $F_{n+1}$ have corresponding luminance values $L_{n-1}$, $L_n$ and $L_{n+1}$ respectively. The pixels $P'_n$ and $P''_n$ at the coordinate (100*100) within the input frames $F'_n$ and $F''_n$ have corresponding luminance values $L'_n$ and $L''_n$ respectively. The chromatic information (Hue and Saturation) of the pixel $P_n$ is equal to the chromatic information of the pixels $P'_n$ and $P''_n$. In a word, the chromatic information of the input frame (i.e. $F_n$) is equal to that of the two corresponding output frames (i.e. $F'_n$ and $F''_n$). The first luminance difference WL1 between the luminance $L_n$ and the luminance $L_{n-1}$ is −50 ($L_n-L_{n-1}$) and the second luminance difference $W_{L2}$ between the luminance $L_n$ and the luminance $L_{n+1}$ is 40 ($L_n-L_{n+1}$). Accordingly, the luminance $L'_n$ and the luminance $L''_n$ are obtained 50 and 120 respectively based on the luminance difference $W_{L1}$ and $W_{L2}$. As above description, an input frame $F_n$ generates two corresponding output frames $F'_n$ and $F''_n$ according to the first and second luminance differences $W_{L1}$ and $W_{L2}$. In another embodiment, the input frames are detected by a luminance detector. The luminance of each pixel is detected and each corresponding luminance difference between two consecutive input frames is computed. In addition, information on objection motion and edge contrast is taken into consideration. The edge detection is to identify whether a pixel is located on the edge of objects within the input frame. Furthermore, motion estimation is performed to estimate an orbit of a moving object (i.e. motion vector) between two consecutive input frames. The luminance of pixels within output frames are compensated according to luminance differences, edge information and motion information.

Figure 3:
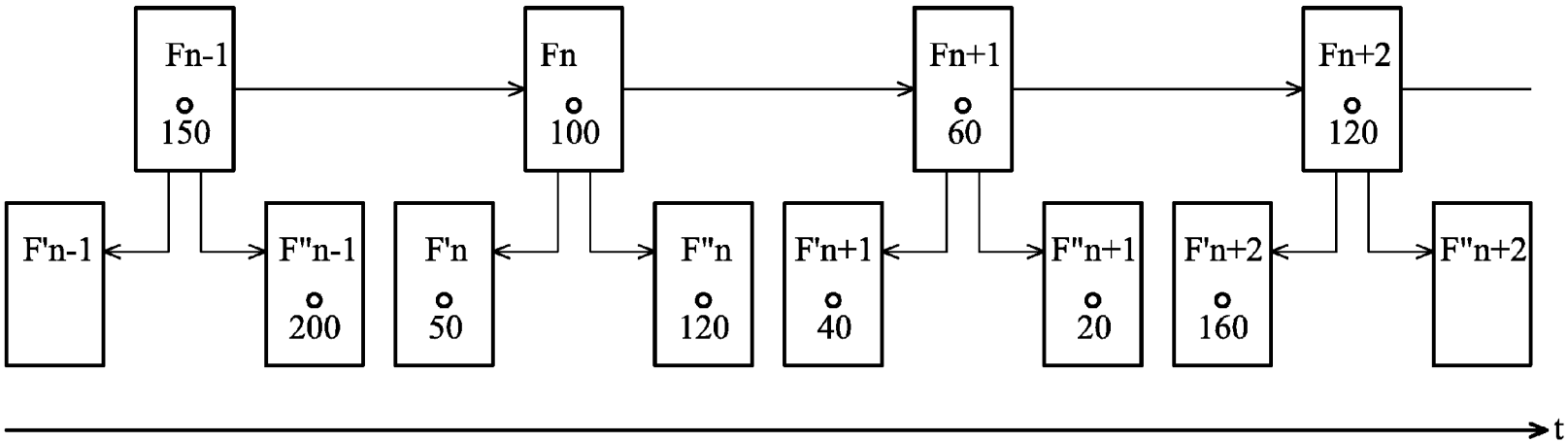
FIG. 3 shows a consecutive input frames and a correspond output frames for a luminance variation of a pixel accompanying time according to an embodiment of the present invention.

FIG. 3 is a diagram showing a consecutive input frames and a consecutive output frames for a luminance variation of a pixel accompanying time according to the present invention. The luminance of the pixel locating at coordinate (100,100) within the input frames $F_n$-$F_{n+3}$ are values of 150, 100, 60 and 120 respectively. The luminance of the pixel locating at coordinate (100,100) within the output frames $F''_{n-1}$, $F'_n$, $F''_n$, $F'_{n+1}$, $F''_{n+1}$ and $F'_{n+2}$ are the values of 200, 50, 120, 40, 20 and 160 respectively after compensating luminance. The input frame $F_n$ generates two corresponding output frames $F'_n$ and $F''_n$, wherein the chromatic information of the two corresponding output frames $F'_n$ and $F''_n$ are equal to that of the input frame $F_n$. In the same way, the output frames $F'_{n+2}$, $F''_{n+2}$, $F'_{n+3}$ and $F''_{n+3}$ are generated. The frame number is increased twice, and thereby the frame rate is therefore raised twice. The luminance difference between two consecutive output frames is also enhanced.

Figure 4:
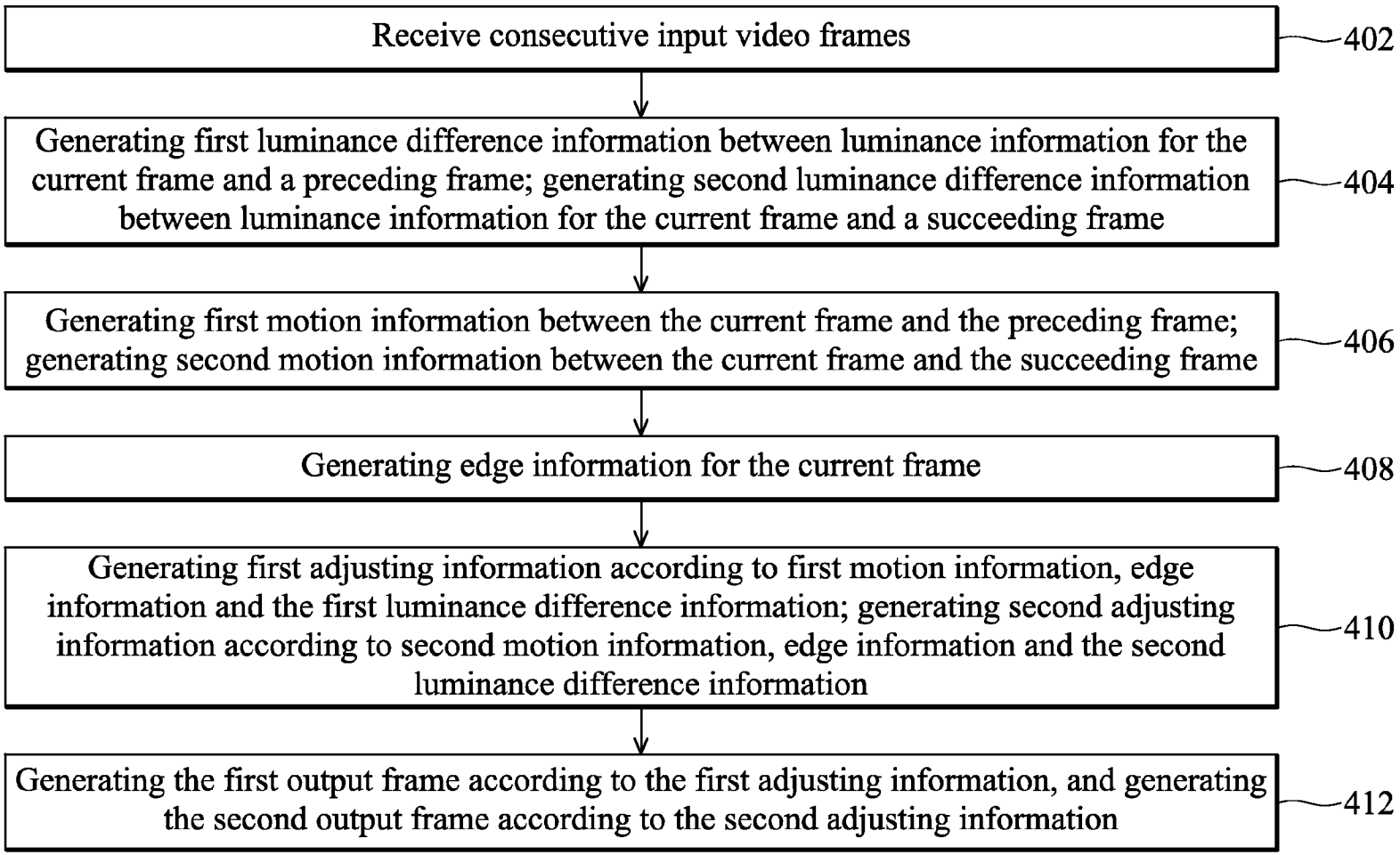
FIG. 4 shows a flow chart illustrating the method for frame rate up conversion according an embodiment of the present invention.

FIG. 4 shows a flow chart illustrating the method for frame rate up conversion according to an embodiment of the present invention. At step 402, a consecutive input frames at a 1/60 of a frame rate is received. At step 404, luminance information (lightness, intensity) for the input frames is detected. First luminance difference information between luminance information for the current frame and a preceding frame is generated and second luminance difference information between luminance information for the current frame and a succeeding frame is generated. At step 406, first motion information (motion vectors) between the current frame and the preceding frame, and second motion information (motion vectors) between the current frame and the succeeding frame are generated. At step 408, edge information for the current frame is generated. At step 410, first adjusting information is generated according to the first motion information, the edge information and the first luminance difference information, and second adjusting information is generated according to the second motion information, the edge information and the second luminance difference information. At step 412, the first output frame is generated according to the first adjusting information, and the second output frame is generated according to the second adjusting information. Moreover, the luminance information for the first and second output frames are generated by compensating the luminance information for the current frame, and the chromatic information of the first and second output frames are equal to the chromatic information of the current frame.

For example in FIG. 2, the luminance difference between input frames $F_{n-1}$ and $F_n$ is value of −50. The edge information for the current frame $F_n$ is detected. The first motion information between the preceding frame $F_{n-1}$ and the current frame $F_n$. The first adjusting value is generated according to the first luminance difference, the first motion information, and the edge information. The luminance of a pixel $P'_n$ within a first output frame $F'_n$ is compensated according to the first adjusting value. The chromatic information of the pixel $P'_n$ is equal to the chromatic information of the pixel $P_n$. The first output frame $F'_n$ is generated based on a pixel-by-pixel basis. In the same way, the second output frame $F''_n$ is also generated according to the second adjusting information and the chromatic information of the current frame $F_n$. the pixel $P'_n$ may be obtained by the function of $$W=a*(L_n-L_{n-1})+b*M+c*E$$

$$P'_n=P_n*(1+d*W)$$

wherein, the symbol M represents for first motion information; the symbol E represents for edge information; the symbol W represents for first adjusting value; the symbol a to d represent for corresponding coefficients.

Because one input frame generates two corresponding output frames according to the two adjacent input frames, the output frame number are twice that of the input frame number. For this reason, output frame rate is also increased. Preferably, the luminance difference of a pixel between the adjacent frames is enhanced when compared with that of the pixel between the input frames. Meanwhile, the overdriving voltages for pixel elements can also be determined and utilized for preferred luminance. Then, the overdriving voltages are applied to drive hardware (pixel elements) for target pixel values according to the video processing algorithm. Each luminance transition of a pixel from previous value to next target value in accordance with the new frame rate is displayed on the display device.

Figure 5:
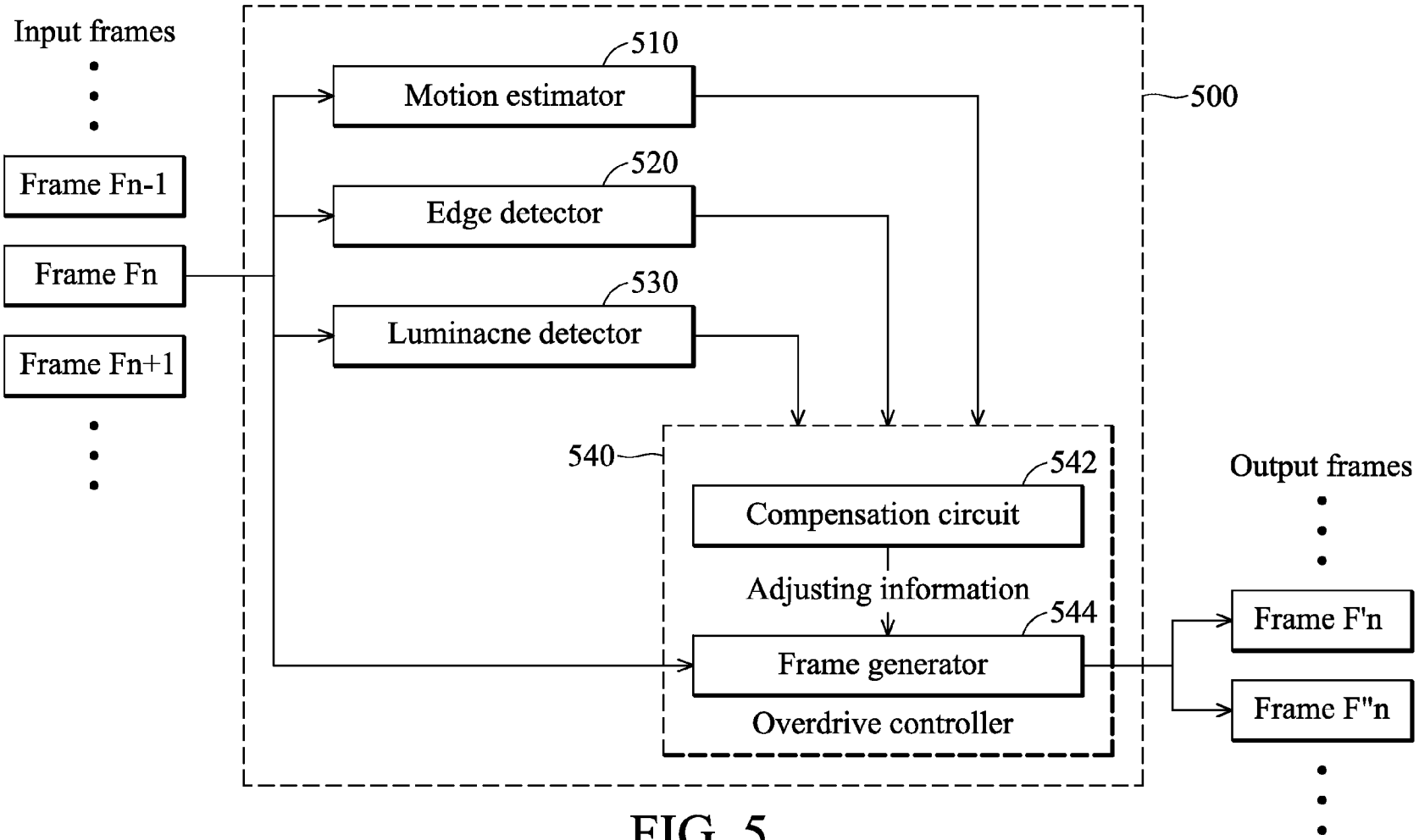
FIG. 5 shows a frame rate up-converter employed to implement the invention.

FIG. 5 shows a device employed to implement the invention. The frame rate up-converter 500 includes a motion estimator 510, an edge detector 520, a luminance detector 530 and an overdrive controller 540. The overdrive controller 540 further includes a frame generator 542 and a compensation circuit 544. The input frames are received by the motion estimator 510, edge detector 520, luminance detector 530 and overdrive controller 540. The motion estimator 510 generates first motion information (motion vectors) between a current frame and a preceding frame, and second motion information (motion vectors) between the current frame and the succeeding frame. The edge detector 520 generates edge information for the current frame. The luminance detector 530 detects luminance information (lightness or intensity) for the current frame. The overdrive controller 540 generates a first output frame according to the first motion information, edge information and the luminance information for the current frame and a preceding frame before the current frame, and generates a second output frame according to the second motion information, the edge information and the luminance information for the current frame and a succeeding frame after the current frame, wherein the second output frame is outputted after the first output frame.

The overdrive controller 540 includes a compensation circuit 542 and a frame generator 544. The compensation circuit 542 generates first adjusting information according to the first motion information, the edge information and the luminance information for the current frame and a preceding frame, and generates second adjusting information according to the second motion information, the edge information and the luminance information for the current frame and a succeeding frame. In more detail, the compensation circuit 542 generates the first adjusting information by referring the difference information between the luminance information for the current frame and the preceding frame. The compensation circuit 542 generates the second adjusting information by referring the difference information between the luminance information for the current frame and the succeeding frame. The frame generator 544 generates the first output frame according to the first adjusting information, and generates the second output frame according to the second adjusting information, wherein the luminance information for the first and second output frames are generated by compensating the luminance information for the current frame, and the chromatic information (Hue and Saturation) of the first and second output frames are equal to the chromatic information of the current frame.

For example in FIG. 2 to determined an output pixel. The motion estimator 510 generates first motion information between the preceding frame $F_{n-1}$ and the current frame $F_n$. The edge detector 520 generates edge information for the current frame $F_n$. The luminance detector 530 detects the luminance of pixels $L_{n-1}$ and $L_n$ respectively within the preceding frame $F_{n-1}$ and the current frame $F_n$. The compensation circuit 542 generates the first adjusting value according to the first motion information, the edge information and the luminance of pixels $L_{n-1}$ and $L_n$. Moreover, the compensation circuit 542 refers the luminance difference $W_{L1}$ between the luminance of pixels $L_{n-1}$ and $L_n$ The frame generator 544 generates the pixel $P'_n$ within the first output frame $F'_n$ according to the first adjusting value and the chromatic information of the pixel $P_n$, and then generates the first output frame $F'_n$ based on pixel-by-pixel operation. In more detail, the luminance of the pixel $P'_n$ is generated according to the first adjusting value, and the chromatic information of the pixel $P'_n$ is equal to the chromatic information of the pixel $P_n$. Accordingly, each pixel within the first output frame $F'_n$ is generated. In the same way, the second output frame $F''_n$ is also generated according to the second adjusting information and the chromatic information of the current frame $F_n$.

The number of the output frames may be increased and the frame rate may be faster for the reason that an input frame (i.e. Frame $F_n$) may generate two corresponding output frames (i.e. Frames $F'_n$ and $F''_n$). In addition, each luminance of a pixel within the output frame is compensated but the chromatic information (Hue and Saturation) of the pixel is equal to the corresponding input frame. For the two consecutive output frames, the luminance difference of the pixel is enhanced compared with the two consecutive input frames. Thus, the output frames have different frame rate and luminance difference information from the input video frames.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for frame rate up conversion, executed by a frame rate up-converter, comprising:

receiving a plurality of consecutive input video frames by the frame rate up-converter;

detecting luminance information for a current frame; and generating a first output frame according to the luminance information for the current frame and a preceding frame before the current frame, and generating a second output frame according to the luminance information for the current frame and a succeeding frame after the current frame, wherein the second output frame is outputted after the first output frame, the luminance information for the first and second output frames are generated by compensating the luminance information for the current frame, and chromatic information of the first and second output frames are equal to the chromatic information of the current frame.

2. The method as claimed in claim 1, the generating step further comprising:

generating first adjusting information according to the luminance information for the current frame and a preceding frame, and for generating second adjusting information according to the luminance information for the current frame and a succeeding frame; and generating the first output frame according to the first adjusting information, and the second output frame according to the second adjusting information.

3. The method as claimed in claim 2, wherein the first adjusting information is generated by referring the difference information between the luminance information for the current frame and the preceding frame, and the second adjusting information is generated by referring the difference information between the luminance information for the current frame and the succeeding frame.

4. The method as claimed in claim 1 is performed on a pixel-by-pixel basis.

5. The method as claimed in claim 1, the generating step further comprising:

generating first motion information between the current frame and the preceding frame, and second motion information between the current frame and the succeeding frame;

generating edge information for the current frame; and generating the first output frame further according to first motion information and the edge information, and generating the second output frame further according to the second motion information and the edge information.

6. A frame rate up-converter for receiving a plurality of consecutive input frames, comprising:

a luminance detector for detecting luminance information for a current frame;

an overdrive controller for generating a first output frame according to the luminance information for the current frame and a preceding frame before the current frame, and generating a second output frame according to the luminance information for the current frame and a succeeding frame after the current frame, wherein the second output frame is outputted after the first output frame, the luminance information for the first and second output frames are generated by compensating the luminance information for the current frame, and chromatic information of the first and second output frames are equal to the chromatic information of the current frame.

7. The frame rate up-converter as claimed in claim 6, wherein the overdrive controller comprises:

a compensation circuit for generating first adjusting information according to the luminance information for the current frame and a preceding frame, and for generating second adjusting information according to the luminance information for the current frame and a succeeding frame; and a frame generator for generating the first output frame according to the first adjusting information, and generating the second output frame according to the second adjusting information.

8. The frame rate up-converter as claimed in claim 7, wherein the compensation circuit refers the difference information between the luminance information for the current frame and the preceding frame to generate the first adjusting information, and the difference information between the luminance information for the current frame and the succeeding frame to generate the second adjusting information.

9. The frame rate up-converter as claimed in claim 6 is implemented on a pixel-by-pixel basis.

10. The frame rate up-converter as claimed in claim 6, further comprising:

a motion estimator for generating first motion information between the current frame and the preceding frame, and second motion information between the current frame and the succeeding frame;

an edge detector for generating edge information for the current frame; and the overdrive controller for generating the first output frame further according to first motion information and the edge information, and the second output frame further according to the second motion information and the edge information.

* * * * *